US012269702B2

(12) United States Patent
Yamamoto

(10) Patent No.: US 12,269,702 B2
(45) Date of Patent: Apr. 8, 2025

(54) SHEET PROCESSING DEVICE

(71) Applicant: TOSHIBA TEC KABUSHIKI KAISHA, Tokyo (JP)

(72) Inventor: Mikio Yamamoto, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 188 days.

(21) Appl. No.: 18/177,150

(22) Filed: Mar. 2, 2023

(65) Prior Publication Data

US 2024/0294352 A1 Sep. 5, 2024

(51) Int. Cl.

| | |
|---|---|
| ***B65H 45/30*** | (2006.01) |
| ***B65H 37/06*** | (2006.01) |
| ***B65H 45/16*** | (2006.01) |
| *B65H 29/12* | (2006.01) |

(52) U.S. Cl.

CPC ..... *B65H 45/30* (2013.01); *B65H 37/06* (2013.01); *B65H 45/16* (2013.01); *B65H 29/125* (2013.01); *B65H 2301/4474* (2013.01)

(58) Field of Classification Search

CPC ..... B31F 1/0006; B31F 1/0035; B65H 45/12; B65H 45/30; B65H 2701/13212; B65H 2301/51232

USPC ..... 270/32, 45

See application file for complete search history.

(56) References Cited

U.S. PATENT DOCUMENTS

| | | | | |
|---|---|---|---|---|
| 8,083,218 | B2 * | 12/2011 | Dobashi | B65H 45/18 270/32 |
| 8,201,815 | B2 * | 6/2012 | Sasahara | G03G 15/6582 270/32 |
| 8,500,111 | B2 * | 8/2013 | Terao | B65H 45/18 270/32 |
| 9,815,656 | B2 * | 11/2017 | Awano | B65H 45/12 |
| 9,897,962 | B2 * | 2/2018 | Osada | B65H 45/18 |
| 2016/0214828 | A1 | 7/2016 | Osada et al. | |

* cited by examiner

*Primary Examiner* — Leslie A Nicholson, III

(74) *Attorney, Agent, or Firm* — Amin, Turocy & Watson, LLP

(57) ABSTRACT

According to one embodiment, a sheet processing device includes a folding unit and a fold-enhancing unit. The folding unit folds a sheet and thus forms a fold line thereon. The fold-enhancing unit includes a fold-enhancing roller, an opposite member, and an auxiliary roller. The fold-enhancing roller moves along a fold-line direction in which the fold line on the sheet formed by the folding unit extends. The opposite member sandwiches the fold line with the fold-enhancing roller. The auxiliary roller rolls over the sheet from the same side as the fold-enhancing roller. The auxiliary roller is displaced in a unified manner with the fold-enhancing roller in the fold-line direction and the direction of the thickness of the folded sheet. A drag torque generated by the movement of the fold-enhancing roller in the fold-line direction is higher in the auxiliary roller than in the fold-enhancing roller.

20 Claims, 9 Drawing Sheets

SHEET PROCESSING DEVICE

FIELD

Embodiments described herein relate generally to a sheet processing device and methods related thereto.

BACKGROUND

A sheet processing device includes a folding unit that folds a sheet and thus forms a fold line thereon, and a fold-enhancing unit that enhances the fold line on the sheet. The fold-enhancing unit reinforces the fold line by pressing the fold line with a roller moving along the fold line. A sheet processing device in which a roller can smoothly run onto a sheet when approaching the sheet is demanded.

DETAILED DESCRIPTION

In general, according to one embodiment, a sheet processing device includes a folding unit and a fold-enhancing unit. The folding unit folds a sheet and thus forms a fold line thereon. The fold-enhancing unit includes a fold-enhancing roller, an opposite member, and an auxiliary roller. The fold-enhancing roller moves along a fold-line direction in which the fold line on the sheet formed by the folding unit extends. The opposite member sandwiches the fold line with the fold-enhancing roller. The auxiliary roller rolls over the sheet from the same side as the fold-enhancing roller. The auxiliary roller is displaced in a unified manner with the fold-enhancing roller in the fold-line direction and the direction of the thickness of the folded sheet. A drag torque generated by the movement of the fold-enhancing roller in the fold-line direction is higher in the auxiliary roller than in the fold-enhancing roller. According to another embodiment, a sheet processing method involves folding a sheet to form a fold line thereon using a folding component; moving a fold-enhancing roller along a fold-line direction in which the fold line on the sheet formed by the folding component extends; sandwiching the fold line with an opposite member and the fold-enhancing roller; rolling an auxiliary roller over the sheet from the same side as the fold-enhancing roller, the auxiliary roller being displaced in a unified manner with the fold-enhancing roller in the fold-line direction and a direction of thickness of the sheet that is folded; and generating a drag torque by the movement of the fold-enhancing roller in the fold-line direction higher in the auxiliary roller than in the fold-enhancing roller.

The sheet processing device according to the embodiment will now be described with reference to the drawings. In the description below, components having the same or similar functions are denoted by the same reference sign. The repeated explanation of such components may be omitted.

Figure 1:
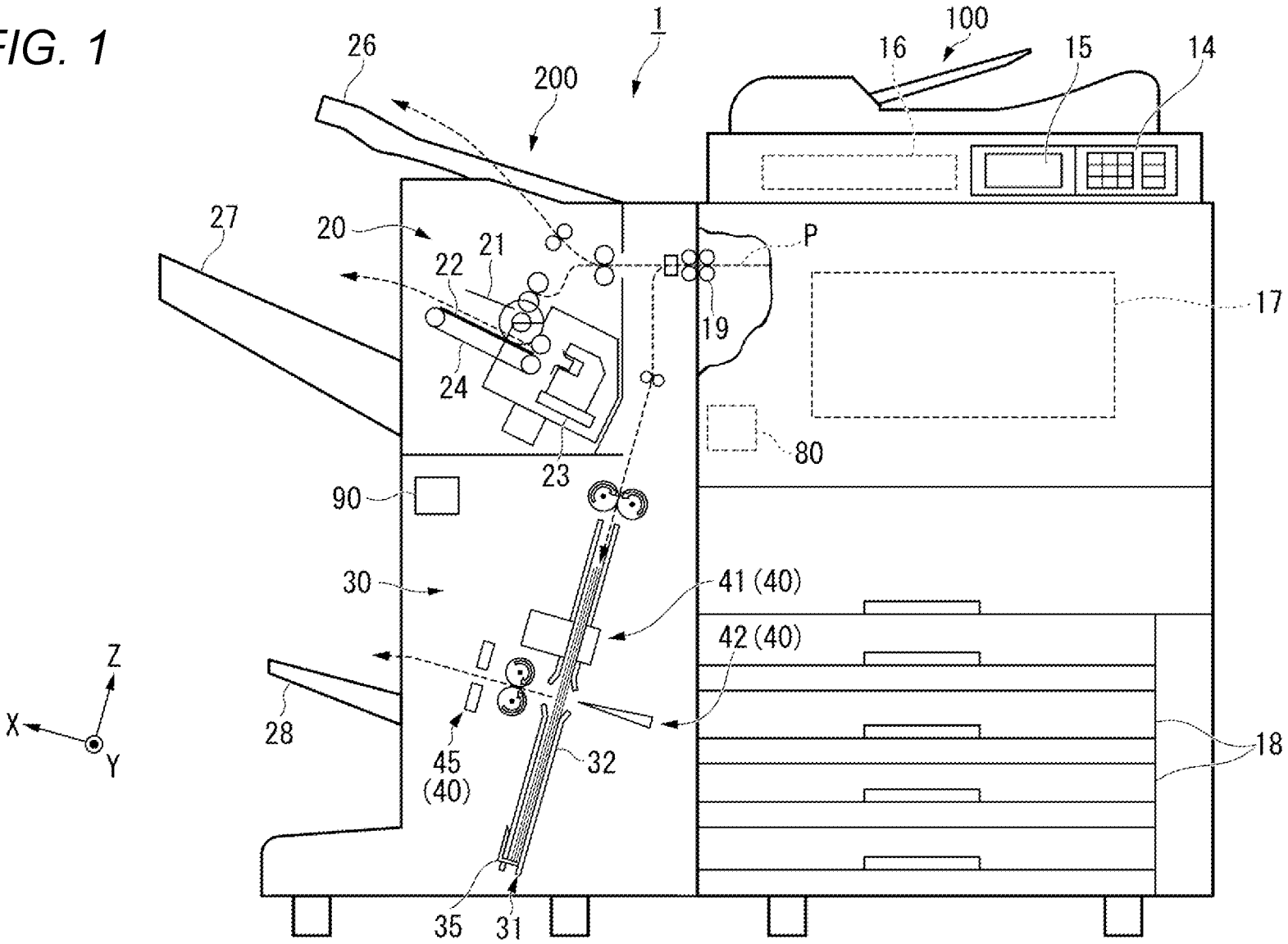
FIG. 1 is a view of a schematic configuration of an image forming device.

FIG. 1 is a view of a schematic configuration of an image forming device 1. For example, the image forming device 1 is arranged at a workplace. The image forming device 1 includes an image forming device main body 100 and a sheet processing device 200. The image forming device main body 100 and the sheet processing device 200 are arranged next to each other.

The image forming device main body 100 will now be described.

The image forming device main body 100 forms an image on a sheet P (recording medium), using a recording agent. The sheet P is, for example, a normal paper or a sticker paper. A specific example of the recording agent is a toner. The toner is either a toner used as a decolorable recording agent or a toner used as a non-decolorable recording agent.

The image forming device main body 100 is, for example, a multifunction peripheral. As shown in FIG. 1, the image forming device main body 100 includes a display unit 15, an operation unit 14, an image reading unit 16, a printer unit 17, a sheet container unit 18, a paper discharge roller 19, and a first control unit 80.

The display unit 15 is an image display device such as a liquid crystal display or an organic EL (electroluminescence) display. The display unit 15 displays various information about the image forming device main body 100 and the sheet processing device 200.

The operation unit 14 has a plurality of buttons. The operation unit 14 accepts a user's operation. The operation unit 14 outputs a signal corresponding to an operation carried out by the user, to the first control unit 80 of the image forming device main body 100. The display unit 15 and the operation unit 14 may be formed as an integrated touch panel.

The image reading unit 16 reads image information of a reading target, based on the brightness and darkness of light. The image reading unit 16 outputs the read image information to the printer unit 17.

The sheet container unit 18 contains the sheet P to be used for image formation. The sheet container unit 18 supplies the sheet P contained therein, to the printer unit 17.

The printer unit 17 forms an image on a sheet, based on image information generated by the image reading unit 16 or image information received via a communication line. The printer unit 17 includes an image forming unit, a transfer unit, and a fixing device. The image forming unit forms an electrostatic latent image on a photosensitive drum, based on the image information. The image forming unit causes a toner to adhere to the electrostatic latent image and thus forms a visible image. The transfer unit transfers the visible image onto the sheet. The fixing device heats and pressurizes the toner and thus fixes the visible image onto the sheet.

The paper discharge roller 19 is arranged near a paper discharge port of the image forming device main body 100. The paper discharge roller 19 sends out the sheet P with an image formed thereon, to the sheet processing device 200.

Figure 2:
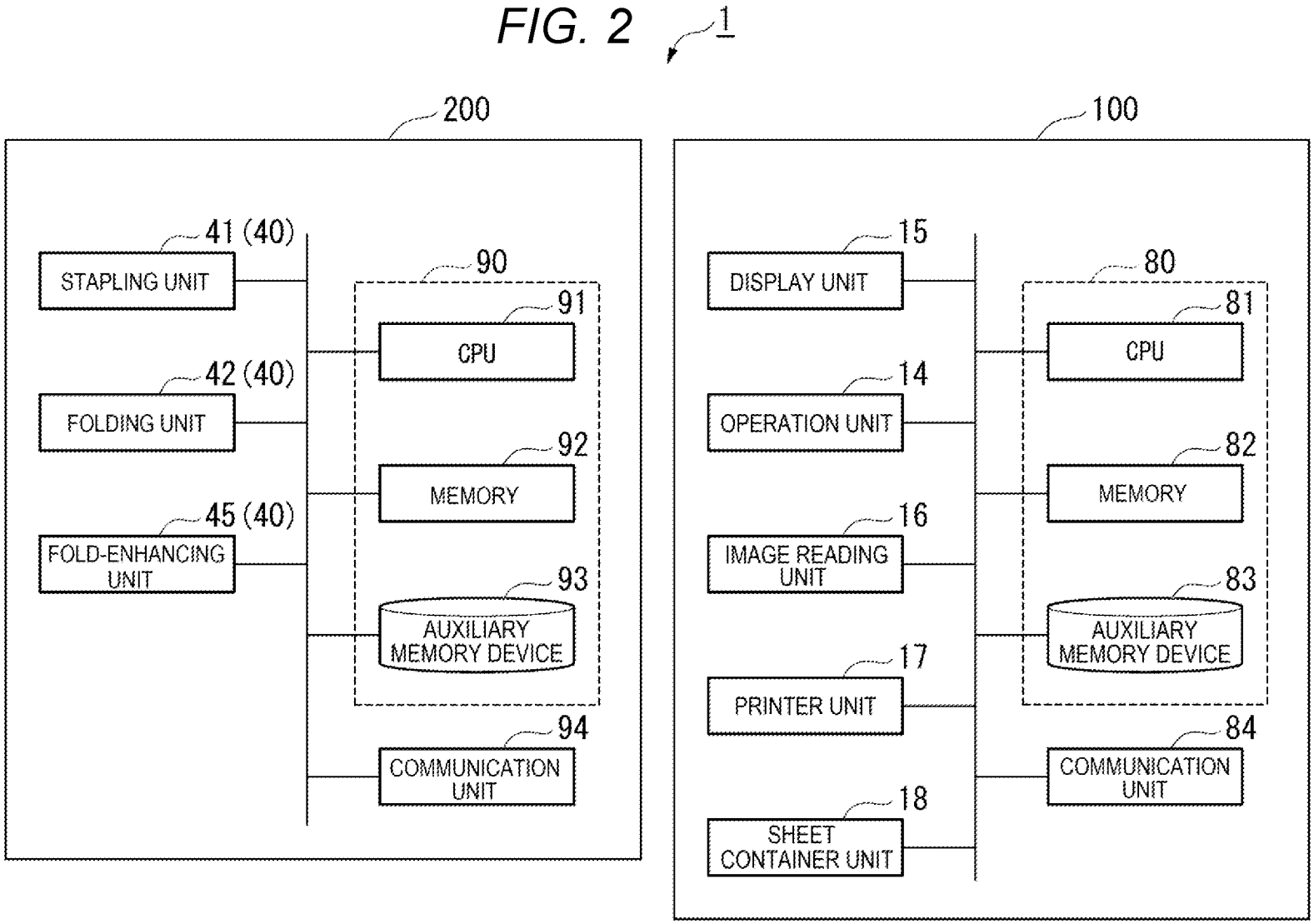
FIG. 2 is a block diagram showing an example of a functional configuration of the image forming device.

FIG. 2 is a block diagram showing an example of the functional configuration of the image forming device 1. As shown in FIG. 2, the image forming device main body 100 includes a CPU (central processing unit) 81, a memory 82, and an auxiliary memory device 83 or the like coupled via a bus, and executes a program. By executing the program, the image forming device main body 100 functions as a device including the display unit 15, the operation unit 14, the image reading unit 16, the printer unit 17, the sheet container unit 18, and a communication unit 84.

The CPU 81 executes a program stored in the memory 82 and the auxiliary memory device 83 and thus functions as the first control unit 80. The first control unit 80 controls the operation of each part of the image forming device main body 100.

The auxiliary memory device 83 is formed using a memory device such as a magnetic hard disk device or a semiconductor memory device. The auxiliary device 83 stores information.

The communication unit 84 is formed including a communication interface for connecting the own device to an external device. The communication unit 84 communicates with the external device via the communication interface. The sheet processing device 200 will now be described.

As shown in FIG. 1, the sheet processing device 200 performs post-processing on the sheet P with an image formed thereon. For example, the post-processing is stapling or V-folding or the like. The sheet processing device 200 includes a stapling mechanism 20, a V-folding mechanism 30, and a second control unit 90.

The stapling mechanism 20 includes a standby tray 21, a processing tray 22, and a stapler 23. The stapler 23 performs stapling at a peripheral edge part of a plurality of sheets P. Hereinafter, a plurality of sheets P is referred to as a sheet bundle. The stapled sheet P is conveyed by a conveyor belt 24 and discharged to a movable tray 27.

The sheet processing device 200 includes the movable tray 27, an upper tray 26, and a lower tray 28. A stapled sheet P is discharged to the movable tray 27. A sheet P that is not stapled is discharged to the upper tray 26. The lower tray 28 is located at a lower part of the sheet processing device 200. A sheet P processed by the V-folding mechanism 30 is discharged to the lower tray 28.

First Embodiment

Figure 3:
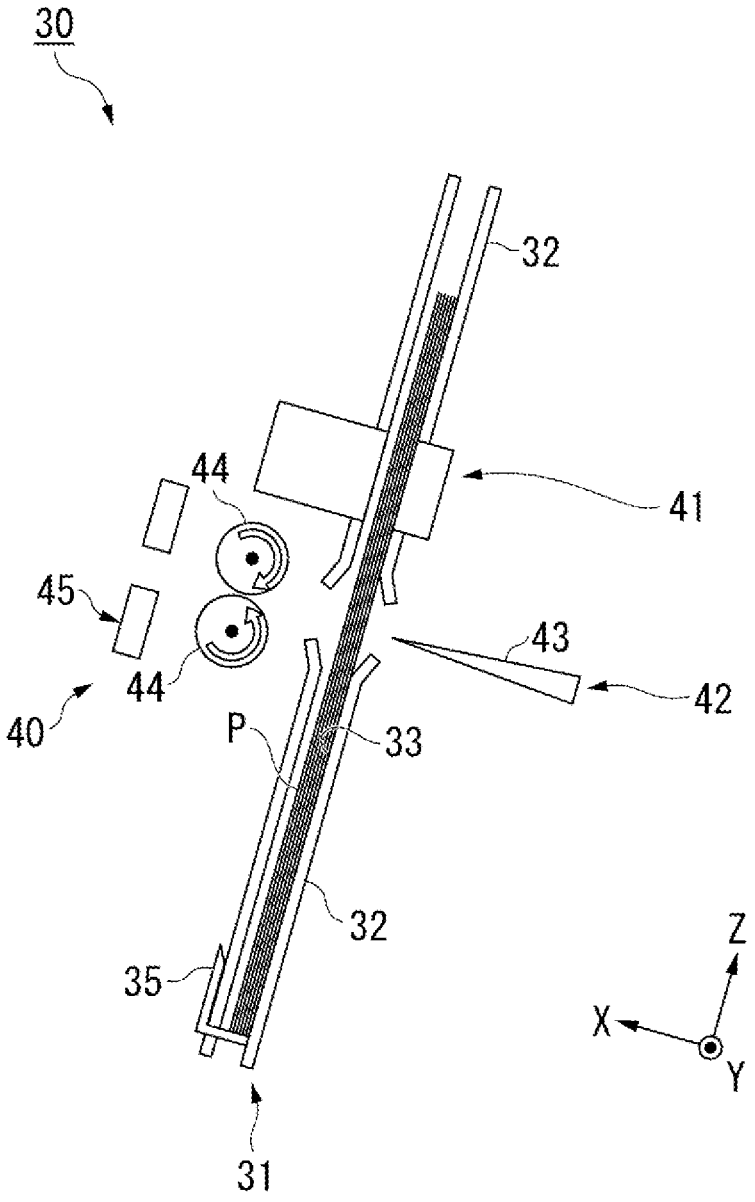
FIG. 3 is a front view showing a schematic configuration of a V-folding mechanism in a sheet processing device according to a first embodiment.

FIG. 3 is a front view showing a schematic configuration of the V-folding mechanism 30 in the sheet processing device 200 according to a first embodiment. As shown in FIG. 3, the V-folding mechanism 30 includes a sheet support unit 31 and a post-processing unit 40. The post-processing unit 40 includes a stapling unit 41, a folding unit 42, and a fold-enhancing unit 45.

The sheet support unit 31 is provided at a downstream end in the direction of conveyance of the sheet P in a conveyor path of the sheet P. The sheet P is stacked in the sheet support unit 31. The sheet support unit 31 includes a bed 32 and a stacker 35. The bed 32 has a paper stacking surface 33 supporting the surface of the sheet P.

As a local coordinate system of the V-folding mechanism 30, an X-direction, a Y-direction, and a Z-direction in an orthogonal coordinate system are defined as follows. The X-direction is the direction of a normal line to the paper stacking surface 33 of the bed 32. A +X-direction is a direction in which the sheet P is placed on the bed 32. The +X-direction is a direction tilted upward from the horizontal direction. The Z-direction is the direction of conveyance of the sheet P in the V-folding mechanism 30. A-Z-direction is a direction in which the sheet P moves toward the sheet support unit 31 through the conveyance path. The −Z-direction is a direction tilted downward from the horizontal direction. The Y-direction is the horizontal direction.

The bed 32 is substantially plate-shaped and configured in such a way that the sheet P can be placed on the paper stacking surface 33 facing in the +X-direction. The bed 32 is located on both sides of the folding unit 42 along the Z-direction. The sheet P arranged on the paper stacking surface 33 is supported by the stacker 35. The stacker 35 regulates the distal end in the −Z-direction of the sheet P conveyed to the sheet support unit 31. The stacker 35 is movable along the Z-direction. For example, the stacker 35 is driven by a moving mechanism arranged in the −X-direction from the bed 32.

The stapling unit 41 processes the sheet P at a position more to the +Z-direction than the position where the sheet P is supported by the stacker 35. The stapling unit 41 is located in the +Z-direction from the folding unit 42. The stapling unit 41 performs stapling at a predetermined position on the sheet P. For example, the predetermined position on the sheet P is a center part in the Z-direction of the sheet P.

The folding unit 42 processes the sheet P at a position more to the +Z-direction than the position where the sheet P is supported by the stacker 35. The folding unit 42 folds the center part in the Z-direction of the sheet P and thus forms a fold line F on the sheet P. The folding unit 42 includes a pair of folding rollers 44 and a blade 43.

The pair of folding rollers 44 are located in the +X-direction from the bed 32. The pair of folding rollers 44 are arrayed in the Z-direction. The axial lines of rotation of the pair of folding rollers 44 extend in the Y-direction. The pair of folding rollers 44 form a nip.

The blade 43 is flat plate-shaped and parallel to the XY plane. The blade 43 is tapered as it goes in the +X-direction. The blade 43 is movable in the X-direction, passing through the bed 32. The blade 43 pushes the sheet P into the nip of the pair of folding rollers 44 and thus forms the fold line F on the sheet P in cooperation with the pair of folding rollers 44.

The fold-enhancing unit 45 is located in the +X-direction from the pair of folding rollers 44. The fold-enhancing unit 45 enhances the fold line F on the sheet P.

The V-folding mechanism 30 can execute, for example, bookbinding of a sheet bundle. In the bookbinding, stapling and V-folding are performed on a sheet bundle stacked in the sheet support unit 31.

In the bookbinding, first, stapling is performed on the sheet bundle. The stacker 35 moves the sheet bundle in the +Z-direction and causes the center part in the Z-direction of the sheet bundle to coincide with the position of the stapling unit 41. The stapling unit 41 performs stapling on the sheet bundle.

Subsequently, V-folding is performed on the stapled sheet bundle. The stacker 35 moves the sheet bundle in the −Z-direction and causes the center part in the Z-direction of the sheet bundle to coincide with the position of the blade 43. The blade 43 moves in the +X-direction and pushes the center part of the sheet bundle in between the pair of folding rollers 44. The sheet bundle is V-folded at the center part in the Z-direction. The fold line F extending in the Y-direction is formed on the end side in the +X-direction of the sheet bundle in the V-folded state. The fold-enhancing unit 45 enhances the fold line F on the sheet bundle. The bookbinding of the sheet bundle is thus completed. The sheet bundle thus bound into a book is discharged to the lower tray 28.

The V-folding mechanism 30 can perform V-folding without performing stapling on one or more sheets P stacked in the sheet support unit 31, instead of the bookbinding. The one or more sheets P is one sheet P or a sheet bundle. In this case, the stacker 35 directly conveys the one or more sheets P from the stack position to the folding unit 42. Subsequently, as in the V-folding in the bookbinding, the fold line F is formed collectively on the one or more sheets P. The sheet P with the fold line F formed thereon is discharged to the lower tray 28.

As shown in FIG. 2, the sheet processing device 200 includes a CPU (central processing unit) 91, a memory 92, and an auxiliary memory device 93 or the like coupled via a bus, and executes a program. By executing the program, the sheet processing device 200 functions as a device including the stapling mechanism 20, the V-folding mechanism 30, and a communication unit 94.

The CPU 91 executes a program stored in the memory 92 and the auxiliary memory device 93 and thus functions as the second control unit 90. The second control unit 90 controls the operation of each part of the sheet processing device 200.

The auxiliary memory device 93 is formed using a memory device such as a magnetic hard disk device or a semiconductor memory device. The auxiliary memory device 93 stores information.

The communication unit 94 is formed including a communication interface for connecting the own device to an external device. The communication unit 94 communicates with the external device via the communication interface. The fold-enhancing unit 45 will now be described.

Figure 4:
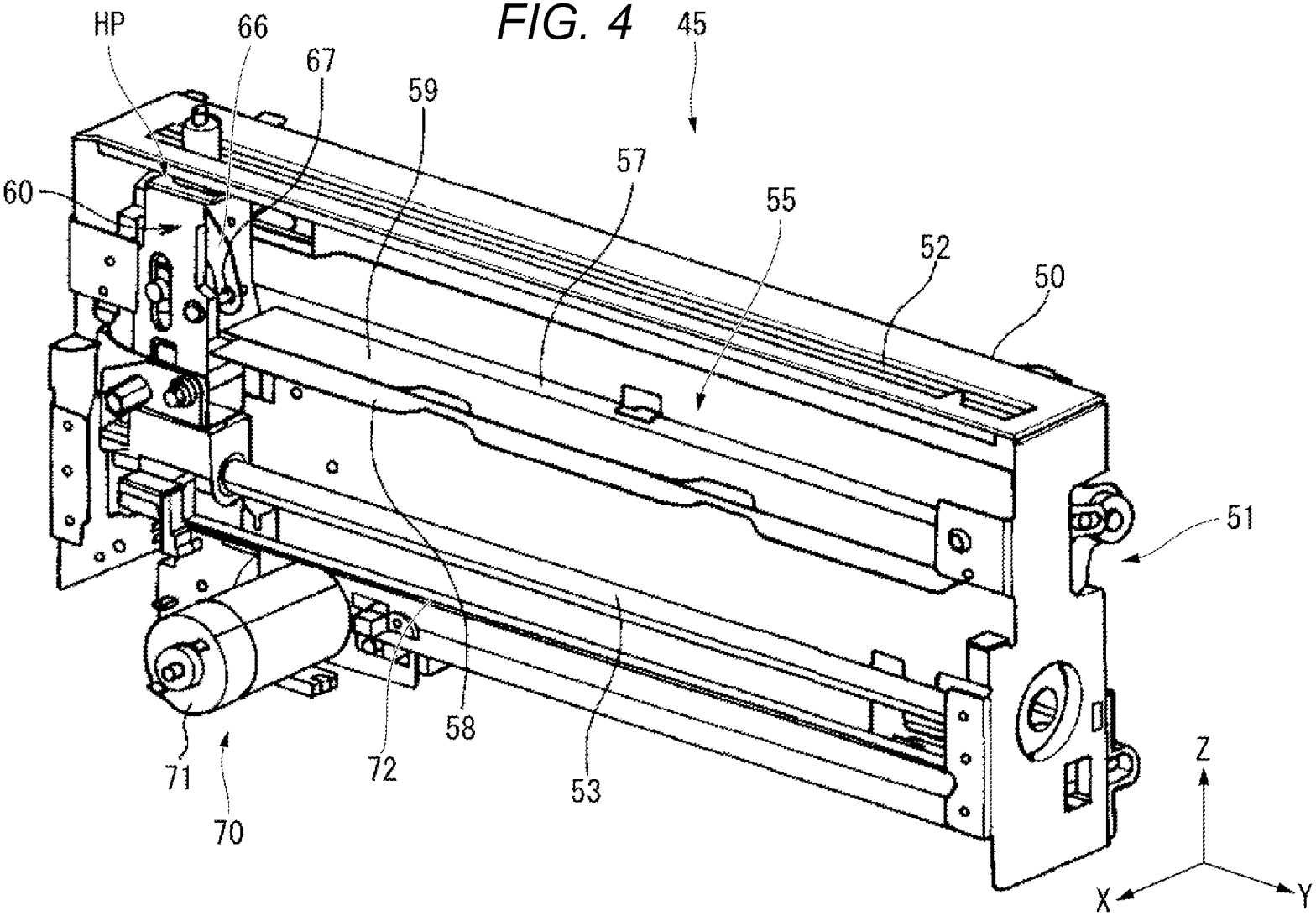
FIG. 4 is a perspective view of a fold-enhancing unit in the sheet processing device.
Figure 5:
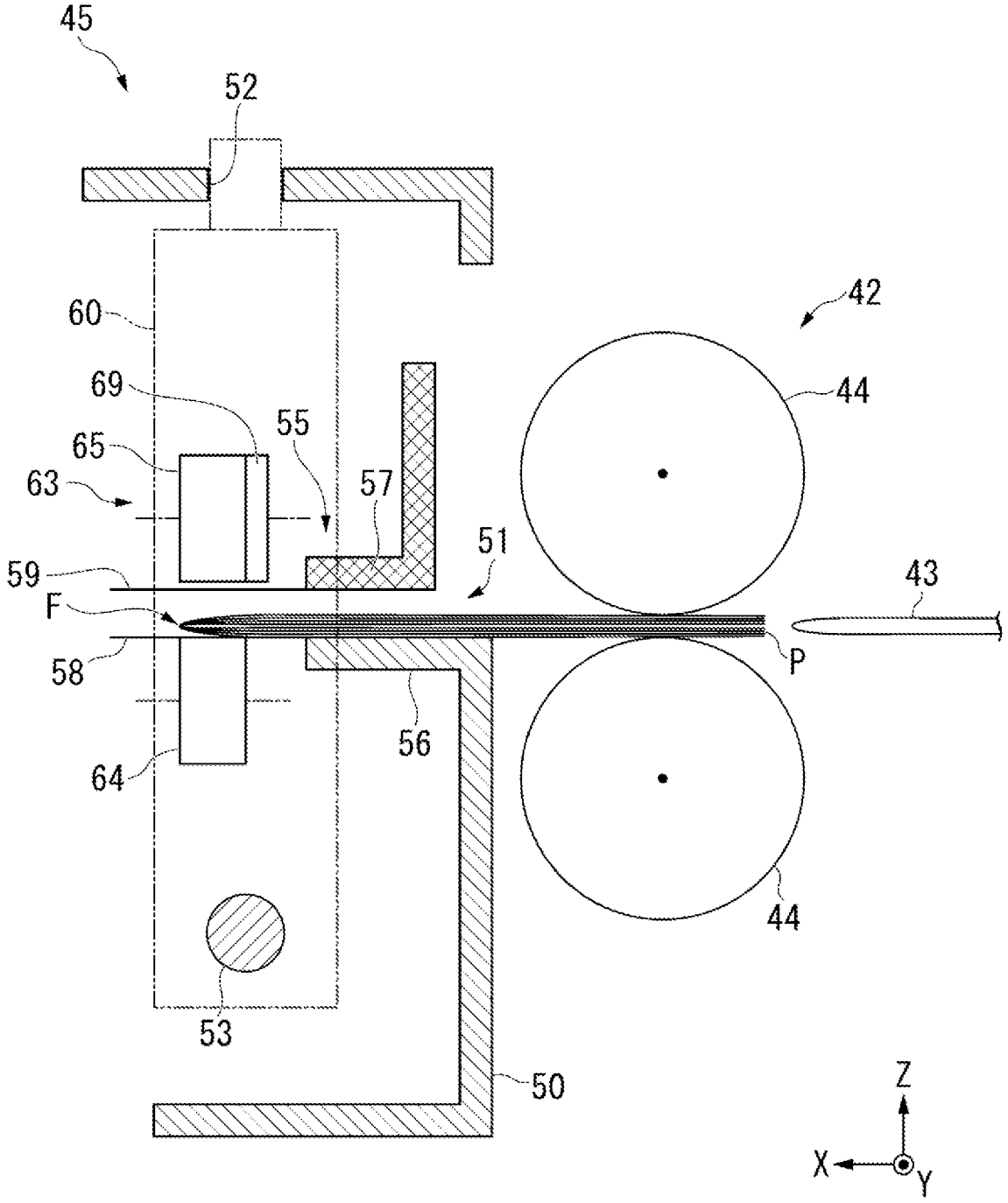
FIG. 5 is a front cross-sectional view showing a schematic configuration of a folding unit and the fold-enhancing unit in the sheet processing device.

FIG. 4 is a perspective view of the fold-enhancing unit 45 in the sheet processing device 200 according to the first embodiment. FIG. 5 is a front cross-sectional view showing a schematic configuration of the folding unit 42 and the fold-enhancing unit 45 in the sheet processing device 200 according to the first embodiment. As shown in FIGS. 4 and 5, the fold-enhancing unit 45 includes a frame 50, a support unit 55, a roller unit 60, and a drive unit 70. In the description below, the fold-enhancing unit 45 is described as in a standby state before a fold-enhancing operation unless described otherwise.

The frame 50 covers the −X-direction, the +Z-direction, the +Y-direction, and the −Y-direction of the fold-enhancing unit 45. The frame 50 has a main plate in the −X-direction. The main plate has a slit 51 extending in the Y-direction. As shown in FIG. 5, the slit 51 allows the entry of the sheet P that is V-folded by the folding unit 42. As shown in FIG. 4, the frame 50 has a top plate in the +Z-direction. The top plate has a guide hole 52 extending in the Y-direction. The frame 50 has a pair of side plates in the +Y-direction and the −Y-direction. The pair of side plates support the two ends of a guide bar 53 extending in the Y-direction. The guide hole 52 and the guide bar 53 guide the movement of the roller unit 60 in the Y-direction.

As shown in FIG. 5, the support unit 55 includes a first support plate 56, a second support plate 57, a first film 58, and a second film 59. The first support plate 56 and the second support plate 57 are parallel to the XY plane.

The first support plate 56 is located at the end in the −Z-direction of the slit 51. The first support plate 56 is fixed to the frame 50. The first support plate 56 supports the sheet P from the −Z-direction.

The second support plate 57 is located in the +Z-direction from the first support plate 56. The second support plate 57 is movable in the Z-direction. The second support plate 57 presses the sheet P into the −Z-direction from the +Z-direction.

The first film 58 and the second film 59 are flexible resin films. The first film 58 and the second film 59 extend in the Y-direction.

The first film 58 is fixed to the end in the +X-direction of the first support plate 56. The first film 58 protrudes in the +X-direction from the first support plate 56. The first film 58 covers the fold line F on the sheet P from the −Z-direction.

The second film 59 is fixed to the end in the +X-direction of the second support plate 57. The second film 59 protrudes in the +X-direction from the second support plate 57. The second film 59 is movable in the Z-direction together with the second support plate 57. The second film 59 covers the fold line F on the sheet P from the +Z-direction.

Figure 6:
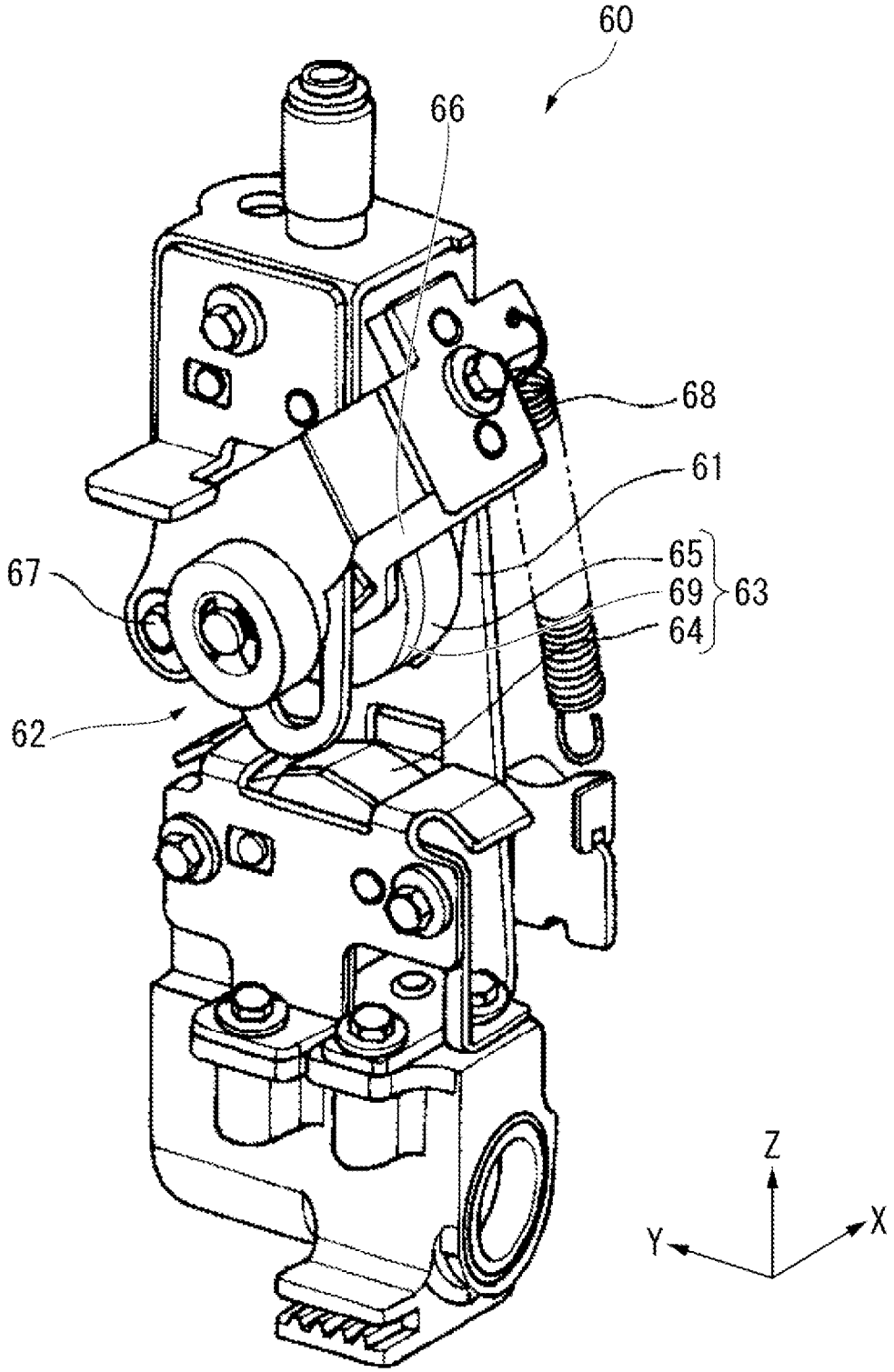
FIG. 6 is a perspective view of a roller unit in the sheet processing device.

FIG. 6 is a perspective view of the roller unit 60 in the sheet processing device 200 according to the first embodiment. As shown in FIG. 6, the roller unit 60 includes a roller frame 61 and a roller set 63.

The roller frame 61 is formed substantially in a C-shape as viewed from the Y-direction and has an opening 62 in the −X-direction. The opening 62 prevents the interference between the sheet P that has entered the fold-enhancing unit 45 and the roller unit 60.

The roller set 63 includes a first fold-enhancing roller (opposite member) 64, a second fold-enhancing roller (fold-enhancing roller) 65, and an auxiliary roller 69. The axial lines of rotation of the first fold-enhancing roller 64, the second fold-enhancing roller 65, and the auxiliary roller 69 extend in the X-direction. The first fold-enhancing roller 64 and the second fold-enhancing roller 65 are arrayed in the Z-direction.

The first fold-enhancing roller 64 is arranged in the −Z-direction from the opening 62 and inside the roller frame 61. The first fold-enhancing roller 64 is supported in a rotatable state by the roller frame 61. For example, the outer circumferential surface of the first fold-enhancing roller 64 is formed of a hard material such as a resin or a metal.

The second fold-enhancing roller 65 is arranged in the +Z-direction from the opening 62 and inside the roller frame 61. The second fold-enhancing roller 65 is supported in a rotatable state by an arm member 66. The arm member 66 is supported in a pivotally movable state around a pivot shaft 67 by the roller frame 61. A coil spring 68 is attached to the arm member 66. For example, the outer circumferential surface of the second fold-enhancing roller 65 is formed of a hard material such as a resin or a metal. The outer circumferential surface of the second fold-enhancing roller 65 is formed of the same material as the outer circumferential surface of the first fold-enhancing roller 64. The diameter of the second fold-enhancing roller 65 is substantially the same as the diameter of the first fold-enhancing roller 64. The first fold-enhancing roller 64 and the second fold-enhancing roller 65 have substantially the same width in the X-direction.

Figure 7:
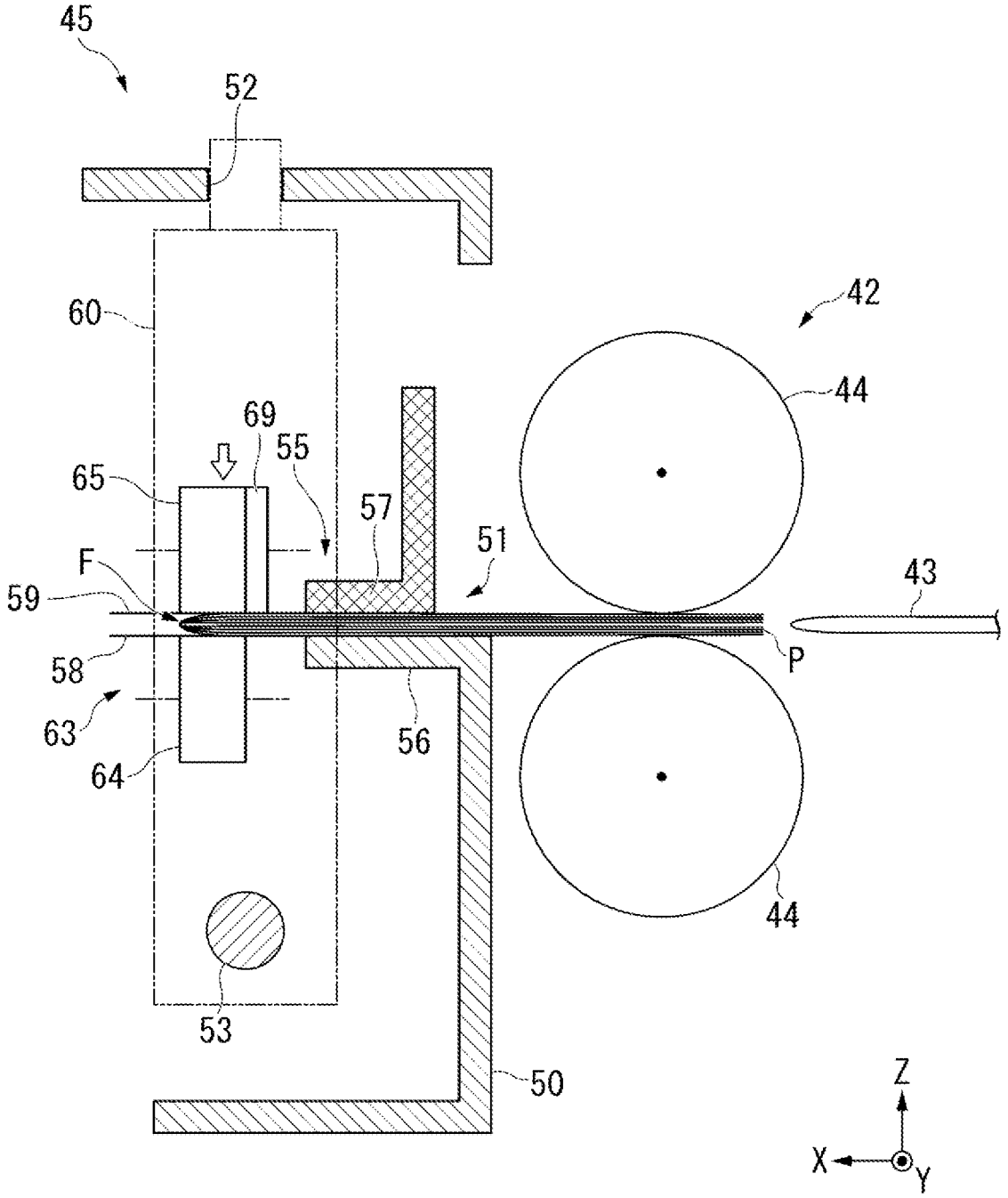
FIG. 7 is an explanatory view of an operation of the fold-enhancing unit shown in FIG. 5.

FIG. 7 is an explanatory view of the operation of the fold-enhancing unit 45 shown in FIG. 5. As shown in FIG. 7, the first fold-enhancing roller 64 and the second fold-enhancing roller 65 are displaced relatively to each other in the Z-direction and thus can move toward and away from each other. In this embodiment, the first fold-enhancing roller 64 is immovable in the Z-direction. The first fold-enhancing roller 64 and the second fold-enhancing roller 65 come into contact with each other via the first film 58 and the second film 59 and thus form a nip. The first fold-enhancing roller 64 and the second fold-enhancing roller 65 sandwich the fold line F on the sheet P between these rollers and move along the Y-direction. The first fold-enhancing roller 64, when moving in the Y-direction, is dragged due to the frictional resistance to the first film 58 and rolls over the sheet P via the first film 58. The second fold-enhancing roller 65, when moving in the Y-direction, is dragged due to the frictional resistance to the second film 59 and rolls over the sheet P via the second film 59. By rolling over the sheet P, the first fold-enhancing roller 64 and the second fold-enhancing roller 65 press and reinforce the fold line F.

The auxiliary roller 69 is arrayed with the second fold-enhancing roller 65 in the X-direction as viewed from the Y-direction. The auxiliary roller 69 is supported in a rotatable state by the arm member 66. The auxiliary roller 69 is displaced in a unified manner with the second fold-enhancing roller 65 in the Y-direction and the Z-direction. The auxiliary roller 69 is located in the −X-direction from the second fold-enhancing roller 65. The auxiliary roller 69 is adjacent to the second fold-enhancing roller 65. However, the auxiliary roller 69 may be spaced apart from the second fold-enhancing roller 65 in the X-direction. The auxiliary roller 69 is provided coaxially with the second fold-enhancing roller 65. The auxiliary roller 69 rotates in a unified manner with the second fold-enhancing roller 65. The outer diameter of the auxiliary roller 69 is equal to or greater than the outer diameter of the second fold-enhancing roller 65. In this embodiment, the auxiliary roller 69 has the same diameter as the second fold-enhancing roller 65. The auxiliary roller 69 does not overlap the second fold-enhancing roller 65 as viewed from either one of the directions orthogonal to the X-direction. However, the auxiliary roller 69 may overlap the first fold-enhancing roller 64 as viewed from one direction orthogonal to the X-direction. The auxiliary roller 69 comes into contact with the second film 59 from the +Z-direction.

The auxiliary roller 69 is softer than the second fold-enhancing roller 65. However, it may suffice that the outer circumferential surface of the auxiliary roller 69 is softer than the outer circumferential surface of the second fold-enhancing roller 65. In this embodiment, the auxiliary roller 69 is made of a rubber. The outer circumferential surface of the auxiliary roller 69 is a smooth surface without bumps and dips. The coefficient of static friction between the outer circumferential surface of the auxiliary roller 69 and the second film 59 is higher than the coefficient of static friction between the outer circumferential surface of the second fold-enhancing roller 65 and the second film 59.

The auxiliary roller 69 is dragged due to the frictional resistance to the second film 59 when moving in the Y-direction. With the movement of the second fold-enhancing roller 65 in the Y-direction, the auxiliary roller 69 rolls over the sheet P via the second film 59 from the same side as the second fold-enhancing roller 65. The drag torque generated when the auxiliary roller 69 rolls over the sheet P is higher than the drag torque generated when the second fold-enhancing roller 65 rolls over the sheet P.

The drive unit 70 is located in the −Z-direction from the fold-enhancing unit 45, as shown in FIG. 4. The drive unit 70 includes a drive belt 72 and a motor 71.

The drive belt 72 is supported between a pair of pulleys spaced apart in the Y-direction. The axes of rotation of the pair of pulleys are parallel to the X-direction. A part of the drive belt 72 is coupled to the roller unit 60. The motor 71 circularly moves the drive belt 72 via the pulleys. Thus, the roller unit 60 moves in the Y-direction.

As shown in FIG. 3, when the V-folding mechanism 30 is in operation, the blade 43 pushes the center part in the Z-direction of the sheet P in between the pair of folding rollers 44. The fold line F on the sheet P is formed on the end side in the +X-direction of the sheet P in the V-folded state. The pair of folding rollers 44 move the sheet P in the +X-direction. As shown in FIG. 5, when the fold line F on the sheet P has reached the space between the first film 58 and the second film 59 in the fold-enhancing unit 45, the movement of the sheet P stops.

The fold-enhancing unit 45 in this embodiment enhances the fold line F on the sheet P in the following manner. The second control unit 90 controls the operation of each part of the fold-enhancing unit 45.

The second support plate 57 and the second film 59 of the support unit 55 move in the −Z-direction. The sheet P is sandwiched between the second support plate 57 and the second film 59, and the first support plate 56 and the first film 58. The fold line F on the sheet P is sandwiched between the first film 58 and the second film 59.

As shown in FIG. 4, the end in the −Y-direction on the inner side of the frame 50 is a home position HP of the roller unit 60. When the V-folding mechanism 30 is not in operation, the roller unit 60 waits at the home position HP. At the home position HP, the second fold-enhancing roller 65 of the roller set 63 shown in FIG. 6 is spaced apart from the first fold-enhancing roller 64 in the +Z-direction.

As the sheet P enters the fold-enhancing unit 45, the roller unit 60 moves in the +Y-direction from the home position HP. With the movement of the roller unit 60, the coil spring 68 pulls down the arm member 66 in the −Z-direction. The second fold-enhancing roller 65 supported by the arm member 66 moves in the −Z-direction and approaches the first fold-enhancing roller 64.

Figure 8:
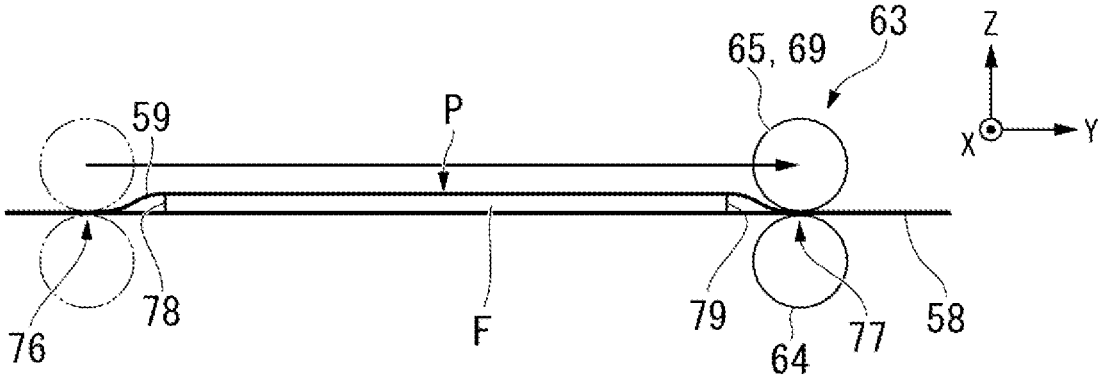
FIG. 8 is a front view of the fold-enhancing unit performing a fold-enhancing operation.

FIG. 8 is an explanatory view of the operation of the fold-enhancing unit 45 shown in FIG. 5. As shown in FIG. 8, the first fold-enhancing roller 64 abuts against the surface facing in the −Z-direction of the first film 58. The second fold-enhancing roller 65 and the auxiliary roller 69 abut against the surface facing in the +Z-direction of the second film 59. The first fold-enhancing roller 64 and the second fold-enhancing roller 65 sandwich the fold line F on the sheet P via the first film 58 and the second film 59. The coil spring 68 shown in FIG. 6 energizes the arm member 66 in the −Z-direction. The second fold-enhancing roller 65 supported by the arm member 66 presses the fold line F on the sheet P via the second film 59. The first fold-enhancing roller 64 and the second fold-enhancing roller 65 move in the Y-direction along the fold line F. Thus, the fold line F on the sheet P is enhanced.

Figure 9:
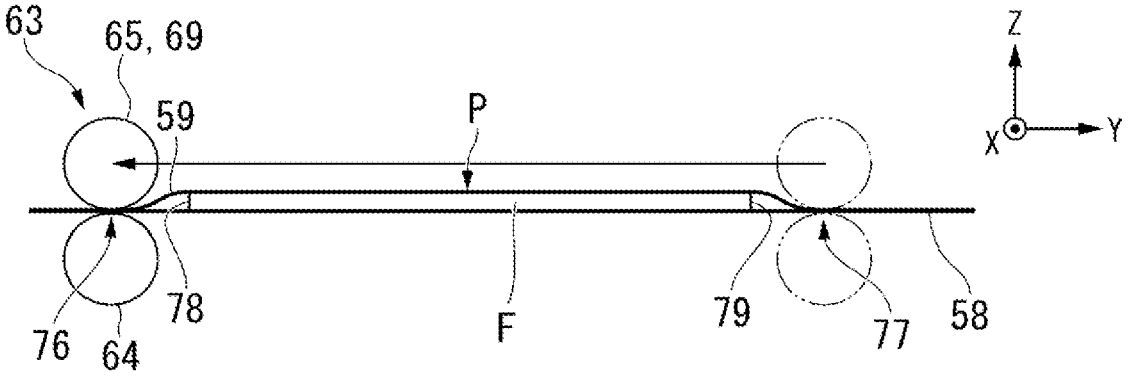
FIG. 9 is a front view of the fold-enhancing unit performing the fold-enhancing operation.

FIG. 9 is a front view of the fold-enhancing unit 45 performing a fold-enhancing operation.

The second control unit 90 moves the first fold-enhancing roller 64 and the second fold-enhancing roller 65 back and forth between the two ends of the fold line F.

In the forward path, the second control unit 90 moves the roller set 63 from a first position 76 located more to the −Y-direction than the sheet P, to a second position 77 located more to the +Y-direction than the sheet P.

The first fold-enhancing roller 64 and the second fold-enhancing roller 65 approach each other in the process of moving in the +Y-direction from the home position HP toward the first position 76. The first fold-enhancing roller 64 and the second fold-enhancing roller 65 sandwich the first film 58 and the second film 59 at the first position 76. The auxiliary roller 69 abuts against the second film 59 at the first position 76. The second fold-enhancing roller 65 and the auxiliary roller 69 come into contact with a first edge 78 in the −Y-direction of the sheet P via the second film 59 in the process of moving in the +Y-direction from the first position 76. The second fold-enhancing roller 65 is regulated in the movement in the +Y-direction by the thickness of the first edge 78 of the sheet P. The auxiliary roller 69 is regulated along with the second fold-enhancing roller 65 in the movement in the +Y-direction by the thickness of the first edge 78 of the sheet P. The auxiliary roller 69 is regulated in the movement in the +Y-direction by the first edge 78 of the sheet P simultaneously with the second fold-enhancing roller 65 or before the second fold-enhancing roller 65 in the process of moving in the +Y-direction.

The second fold-enhancing roller 65 and the auxiliary roller 69 run onto the first edge 78 of the sheet P via the second film 59 due to a drive force in the +Y-direction. The second fold-enhancing roller 65 and the auxiliary roller 69 move in the +Z-direction in relation to the first fold-enhancing roller 64 while moving in the +Y-direction and thus run onto the sheet P. The second fold-enhancing roller 65 and the auxiliary roller 69 move in the +Z-direction while resisting the energizing force of the coil spring 68 via the arm member 66. The second fold-enhancing roller 65 runs onto the sheet P and sandwiches the fold line F on the sheet P with the first fold-enhancing roller 64 via the first film 58 and the second film 59. In the state of sandwiching the fold line F, the first fold-enhancing roller 64 and the second fold-enhancing roller 65 move in the +Y-direction to a second edge 79 in the +Y-direction of the sheet P. The auxiliary roller 69 rolls in the +Y-direction over the sheet P via the second film 59. The first fold-enhancing roller 64, the second fold-enhancing roller 65, and the auxiliary roller 69 move in the +Y-direction beyond the second edge 79 of the sheet P and to the second position 77.

In the backward path, the second control unit 90 moves the roller set 63 from the second position 77 to the first position 76.

The first fold-enhancing roller 64 and the second fold-enhancing roller 65 sandwich the first film 58 and the second film 59 at the second position 77. The auxiliary roller 69 abuts against the second film 59 at the second position 77. The second fold-enhancing roller 65 and the auxiliary roller 69 come into contact with the second edge 79 of the sheet P via the second film 59 in the process of moving in the −Y-direction from the second position 77. The second fold-enhancing roller 65 is regulated in the movement in the −Y-direction by the thickness of the second edge 79 of the sheet P. The auxiliary roller 69 is regulated along with the second fold-enhancing roller 65 in the movement in the −Y-direction by the thickness of the second edge 79 of the sheet P. The auxiliary roller 69 is regulated in the movement in the −Y-direction by the second edge 79 of the sheet P simultaneously with the second fold-enhancing roller 65 or before the second fold-enhancing roller 65 in the process of moving in the −Y-direction.

The second fold-enhancing roller 65 and the auxiliary roller 69 run onto the second edge 79 of the sheet P via the second film 59 due to a drive force in the −Y-direction. The second fold-enhancing roller 65 and the auxiliary roller 69 move in the +Z-direction in relation to the first fold-enhancing roller 64 while moving in the −Y-direction and thus run onto the sheet P. The second fold-enhancing roller 65 and the auxiliary roller 69 move in the +Z-direction while resisting the energizing force of the coil spring 68 via the arm member 66. The second fold-enhancing roller 65 runs onto the sheet P and sandwiches the fold line F on the sheet P with the first fold-enhancing roller 64 via the first film 58 and the second film 59. In the state of sandwiching the fold line F, the first fold-enhancing roller 64 and the second fold-enhancing roller 65 move in the −Y-direction to the first edge 78 of the sheet P. The auxiliary roller 69 rolls in the −Y-direction over the sheet P via the second film 59. The first fold-enhancing roller 64, the second fold-enhancing roller 65, and the auxiliary roller 69 move in the −Y-direction beyond the first edge 78 of the sheet P and to the first position 76. Subsequently, the first fold-enhancing roller 64 and the second fold-enhancing roller 65 move away from each other in the process of moving in the −Y-direction from the first position 76 toward the home position HP.

The fold-enhancing operation is thus completed.

As described above in detail, sheet processing device 200 according to the embodiment includes the fold-enhancing unit 45 having the first fold-enhancing roller 64 and the second fold-enhancing roller 65 sandwiching the fold line F and the auxiliary roller 69 rolling over the sheet P from the same side as the second fold-enhancing roller 65. The auxiliary roller 69 is displaced in a unified manner with the second fold-enhancing roller 65 in the Y-direction and the Z-direction. The drag torque generated by the movement of the second fold-enhancing roller 65 in the Y-direction is higher in the auxiliary roller 69 than in the second fold-enhancing roller 65.

If the auxiliary roller 69 is not provided, there is a case where the second fold-enhancing roller 65 slips on the sheet P when the second fold-enhancing roller 65 is moved in the Y-direction to run onto the sheet P. Also, a case where the roller slips on the film covering the sheet P is included in the case where the roller slips on the sheet P. If the second fold-enhancing roller 65 slips on the sheet P, the drive force to move the second fold-enhancing roller 65 in the Y-direction needs to be increased in order to make the second fold-enhancing roller 65 run onto the sheet P. The drive force required for moving the second fold-enhancing roller 65 in the Y-direction increases as the thickness of the sheet bundle sandwiched by the first fold-enhancing roller 64 and the second fold-enhancing roller 65 increases.

According to the embodiment, the auxiliary roller 69 is less apt to slip on the sheet P than the second fold-enhancing roller 65. Therefore, the auxiliary roller 69 can efficiently convert the drive force to move the second fold-enhancing roller 65 in the Y-direction into a force in the Z-direction. Thus, the second fold-enhancing roller 65 can be made to run onto the sheet P together with the auxiliary roller 69 without needing to increase the drive force to move the second fold-enhancing roller 65 in the Y-direction. Therefore, the second fold-enhancing roller 65 can smoothly run onto the sheet P when approaching the sheet P.

As a result, fold-enhancing can be performed on a sheet bundle with an increased thickness, even with the motor 71 of the drive unit 70 that is the same as in the related art. Also, fold-enhancing can be performed on a sheet bundle with a predetermined thickness by a lower applied current, even with the motor 71 of the drive unit 70 that is the same as in the related art.

The member sandwiching the fold line F on the sheet P with the second fold-enhancing roller 65 is the first fold-enhancing roller 64, which similarly rolls over the sheet P. This configuration can restrain the sliding of the first fold-enhancing roller 64 on the first film 58 to a minimum and thus can restrain damage to the first film 58. Thus, deterioration of the first film 58 can be restrained and reliability can be improved.

The fold-enhancing unit 45 has the second film 59 provided between the sheet P and the auxiliary roller 69. In this configuration, the sheet P and the auxiliary roller 69 can avoid direct contact with each other due to the provision of the second film 59 between these and therefore damage to the sheet P can be restrained. Meanwhile, if the second film 59 is provided between the sheet P and the second fold-enhancing roller 65, the second fold-enhancing roller 65 is more apt to slip due to the sliding on the second film 59. Therefore, the auxiliary roller 69 is provided, thus effectively achieving the foregoing advantageous effects.

The coefficient of static friction on the outer circumferential surface of the auxiliary roller 69 is higher than the coefficient of static friction on the outer circumferential surface of the second fold-enhancing roller 65. This configuration makes the auxiliary roller 69 less apt to slip on the sheet P than the second fold-enhancing roller 65. Thus, the foregoing advantageous effects are achieved.

The auxiliary roller 69 is located in the −X-direction from the second fold-enhancing roller 65. The −X-direction is upstream in the direction of conveyance, in which the sheet P is conveyed to the fold-enhancing unit 45. In this configuration, the second fold-enhancing roller 65 runs onto the fold line F on the sheet P, whereas the auxiliary roller 69 runs onto a site having a thickness equal to or less than at the fold line F on the sheet P. Therefore, the auxiliary roller 69 can more easily run onto the sheet P than in a configuration where the auxiliary roller 69 runs onto the fold line F. Thus, the second fold-enhancing roller 65 can more easily run onto the sheet P together with the auxiliary roller 69.

The auxiliary roller 69 rotates in a unified manner with the second fold-enhancing roller 65. In this configuration, when the auxiliary roller 69 runs onto the sheet P while rotating, the second fold-enhancing roller 65 rotates, too. Therefore, the energy loss due to the slip between the second fold-enhancing roller 65 and the sheet P can be reduced. Thus, an increase in the drive force to move the second fold-enhancing roller 65 in the Y-direction can be restrained effectively.

The auxiliary roller 69 is provided coaxially with the second fold-enhancing roller 65. In this configuration, one member can be used both as the member axially supporting the auxiliary roller 69 and as the member axially supporting the second fold-enhancing roller 65. Therefore, an increase in the number of components can be restrained and complication of the device structure can be avoided.

The auxiliary roller 69 is softer than the second fold-enhancing roller 65. This configuration makes it easier for the end of the sheet P to get stuck in the auxiliary roller 69 when the auxiliary roller 69 runs onto the end of the sheet P. Therefore, the auxiliary roller 69 is less apt to slip on the sheet P than the second fold-enhancing roller 65 and thus achieves the foregoing advantageous effects.

The axial lines of rotation of the auxiliary roller 69 and the second fold-enhancing roller 65 extend in the X-direction, in which the sheet P is conveyed to the fold-enhancing unit 45. This configuration enables the auxiliary roller 69 and the second fold-enhancing roller 65 to come into contact without any tilt with the end extending in the X-direction of the sheet P conveyed to the fold-enhancing unit 45. Thus, the drive force to move the second fold-enhancing roller 65 in the Y-direction can be efficiently converted into the force in the Z-direction to cause the second fold-enhancing roller 65 and the auxiliary roller 69 to run onto the sheet P. Therefore, an increase in the drive force to move the second fold-enhancing roller 65 in the Y-direction can be restrained effectively.

In the first embodiment, the auxiliary roller 69 and the second fold-enhancing roller 65 are provided as separate members. However, the auxiliary roller 69 and the second fold-enhancing roller 65 may be formed of a single roller. For example, an annular groove extending in the entire circumference may be formed at a part in the axial direction of a single hard roller, and a soft circular member made of a rubber or the like may be fitted in the annular groove. Thus, in the single roller, a part equivalent to the second fold-enhancing roller 65 having a hard outer circumferential surface and a part equivalent to the auxiliary roller 69 having a soft outer circumferential surface are formed next to each other in the axial direction.

Second Embodiment

Figure 10:
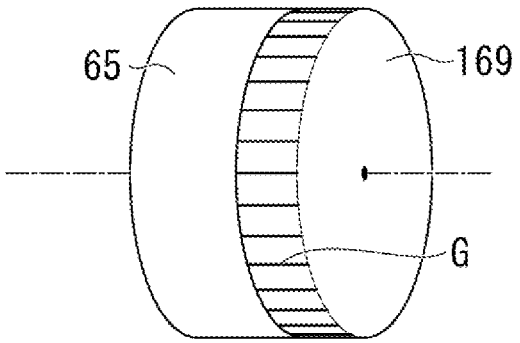
FIG. 10 is a perspective view of a second fold-enhancing roller and an auxiliary roller according to a second embodiment.

FIG. 10 is a perspective view of a second fold-enhancing roller 65 and an auxiliary roller 169 according to a second embodiment. The outer circumferential surface of the auxiliary roller 69 shown in FIG. 5 is a smooth surface without bumps and dips. On the outer circumferential surface of the auxiliary roller 169 shown in FIG. 10, a groove G extending in the axial direction of the auxiliary roller 169 is formed. A plurality of grooves G are formed at an equal distance in the circumferential direction. The other the parts of configuration are similar to those in the first embodiment.

In this configuration, the groove G is caught at the edge of the sheet P via the second film 59, thus effectively making the outer circumferential surface of the auxiliary roller 169 less apt to slip on the sheet P. Thus, effects similar to those of the first embodiment are achieved.

In the second embodiment, the groove G extends in the axial direction. However, as long as the groove extends in a direction intersecting the circumferential direction, the foregoing advantageous effects are achieved. For example, the groove may be formed in a mesh-like form.

Third Embodiment

Figure 11:
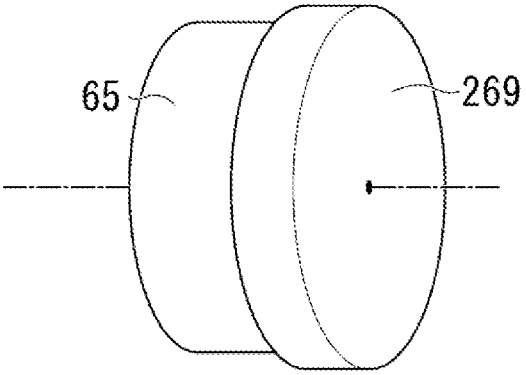
FIG. 11 is a perspective view of a second fold-enhancing roller and an auxiliary roller according to a third embodiment.

FIG. 11 is a perspective view of a second fold-enhancing roller 65 and an auxiliary roller 269 according to a third embodiment. The auxiliary roller 69 shown in FIG. 5 has the same diameter as the second fold-enhancing roller 65. The auxiliary roller 269 shown in FIG. 11 has a larger diameter than the second fold-enhancing roller 65. The other parts of the configuration are similar to those in the first embodiment.

This configuration enables the auxiliary roller 269 to come into contact with the sheet P earlier than the second fold-enhancing roller 65 when the second fold-enhancing roller 65 and the auxiliary roller 269 move in the Y-direction and approach the sheet P. Thus, the auxiliary roller 269 can securely contribute to the operation of causing the second fold-enhancing roller 65 to run onto the sheet P. Therefore, effects similar to those in the first embodiment are achieved.

Fourth Embodiment

Figure 12:
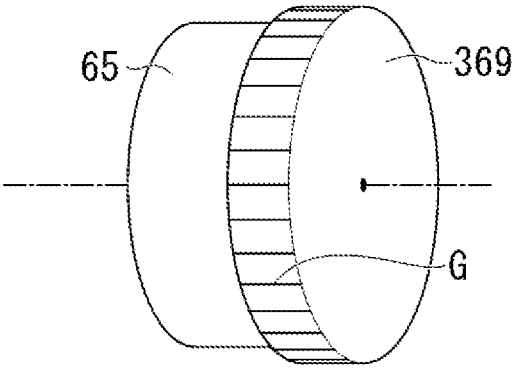
FIG. 12 is a perspective view of a second fold-enhancing roller and an auxiliary roller according to a fourth embodiment.

FIG. 12 is a perspective view of a second fold-enhancing roller 65 and an auxiliary roller 369 according to a fourth embodiment. The outer circumferential surface of the auxiliary roller 69 shown in FIG. 5 is a smooth surface without bumps and dips. Also, the auxiliary roller 69 shown in FIG. 5 has the same diameter as the second fold-enhancing roller 65. On the outer circumferential surface of the auxiliary roller 369 shown in FIG. 12, a groove G extending in a direction intersecting the circumferential direction of the auxiliary roller 369 is formed. Also, the auxiliary roller 369 shown in FIG. 12 has a larger diameter than the second fold-enhancing roller 65. The other parts of the configuration are similar to those in the first embodiment.

In this configuration, the groove G is caught at the edge of the sheet P via the second film 59, thus effectively making the outer circumferential surface of the auxiliary roller 369 less apt to slip on the sheet P. Also, this configuration enables the auxiliary roller 369 to come into contact with the sheet P earlier than the second fold-enhancing roller 65 when the second fold-enhancing roller 65 and the auxiliary roller 369 move in the Y-direction and approach the sheet P. Thus, the auxiliary roller 369 can securely contribute to the operation of causing the second fold-enhancing roller 65 to run onto the sheet P. Therefore, effects similar to those of the first embodiment are achieved.

Each of the above embodiments is configured in such a way that the first fold-enhancing roller 64 and the second fold-enhancing roller 65 sandwich the fold line F on the sheet P. However, instead of the first fold-enhancing roller 64, an opposite member that is not relatively displaceable may be provided in the frame 50. In this case, the opposite member has a length in the Y-direction and is configured to support the fold line F over the entire length and sandwich the fold line F with the second fold-enhancing roller 65.

In each of the above embodiments, the support unit 55 has the first film 58 and the second film 59 covering the fold line F on the sheet P. However, this configuration is not limiting. The support unit may not have a film covering the fold line F on the sheet P. In this case, it is desirable that the coefficient of static friction between the outer circumferential surface of the auxiliary roller 69 and the sheet P is higher than the coefficient of static friction between the outer circumferential surface of the second fold-enhancing roller 65 and the sheet P. This configuration achieves the foregoing advantageous effects. Also, since both of the members sandwiching the fold line F on the sheet P are rollers rolling over the sheet P, the sliding of the first fold-enhancing roller 64 and the second fold-enhancing roller 65 on the sheet P can be restrained to the minimum. Thus, the formation of a trace of sliding on the sheet P is restrained and a V-folded sheet P of high quality can be formed.

According to at least one of the embodiments described above, the drag torque generated by the movement of the second fold-enhancing roller in the Y-direction is higher in the auxiliary roller than in the second fold-enhancing roller. This configuration makes the auxiliary roller less apt to slip on the sheet than the second fold-enhancing roller. Therefore, the auxiliary roller can efficiently convert the drive force to move the second fold-enhancing roller in the Y-direction into the force in the Z-direction. Thus, the second fold-enhancing roller can be made to run onto the sheet together with the auxiliary roller without needing to increase the drive force to move the second fold-enhancing roller in the Y-direction. Therefore, the second fold-enhancing roller can smoothly run onto the sheet when approaching the sheet.

While certain embodiments have been described, these embodiments have been presented by way of example only and are not intended to limit the scope of the present disclosure. Indeed, the novel embodiments described herein may be embodied in a variety of other forms. Furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A sheet processing device, comprising:

a folding component configured to fold a sheet and thereby form a fold line thereon;

a fold-enhancing component comprising a fold-enhancing roller configured to move along a fold-line direction in which the fold line on the sheet formed by the folding component extends, an opposite member configured to sandwich the fold line with the fold-enhancing roller, and an auxiliary roller configured to roll over the sheet from the same side as the fold-enhancing roller, the auxiliary roller being displaced in a unified manner with the fold-enhancing roller in the fold-line direction and a direction of thickness of the sheet that is folded, wherein a drag torque generated by movement of the fold-enhancing roller in the fold-line direction is higher in the auxiliary roller than in the fold-enhancing roller; and a resin film provided between the sheet and the auxiliary roller.

2. The sheet processing device according to claim 1, wherein the opposite member is a roller rolling over the sheet.

3. The sheet processing device according to claim 1, wherein a coefficient of static friction on an outer circumferential surface of the auxiliary roller is higher than a coefficient of static friction on an outer circumferential surface of the fold-enhancing roller.

4. The sheet processing device according to claim 1, wherein a direction of sheet conveyance to the fold-enhancing component is defined, and the auxiliary roller is arranged upstream in the direction of sheet conveyance from the fold-enhancing roller.

5. The sheet processing device according to claim 1, wherein the auxiliary roller rotates in a unified manner with the fold-enhancing roller.

6. The sheet processing device according to claim 1, wherein the auxiliary roller is provided coaxially with the fold-enhancing roller.

7. The sheet processing device according to claim 1, wherein the auxiliary roller has a diameter larger than a diameter of the fold-enhancing roller.

8. The sheet processing device according to claim 1, wherein a groove extending in a direction intersecting a circumferential direction is formed on an outer circumferential surface of the auxiliary roller.

9. The sheet processing device according to claim 1, wherein the auxiliary roller is softer than the fold-enhancing roller.

10. The sheet processing device according to claim 2, wherein a direction of sheet conveyance to the fold-enhancing component is defined, and an axial line of rotation of the fold-enhancing roller and the opposite member extends in a sheet direction of conveyance.

11. A sheet processing method, comprising:

folding a sheet to form a fold line thereon using a folding component;

moving a fold-enhancing roller, of a fold-enhancing component, along a fold-line direction in which the fold line on the sheet formed by the folding component extends;

sandwiching the fold line with an opposite member and the fold-enhancing roller;

rolling an auxiliary roller over the sheet from the same side as the fold-enhancing roller, the auxiliary roller being displaced in a unified manner with the fold-enhancing roller in the fold-line direction and a direction of thickness of the sheet that is folded; and generating a drag torque by movement of the fold-enhancing roller in the fold-line direction higher in the auxiliary roller than in the fold-enhancing roller, wherein the auxiliary roller has a diameter larger than a diameter of the fold-enhancing roller.

12. The sheet processing method according to claim 11, further comprising:

rolling the opposite member over the sheet.

13. The sheet processing method according to claim 11, wherein a coefficient of static friction on an outer circumferential surface of the auxiliary roller is higher than a coefficient of static friction on an outer circumferential surface of the fold-enhancing roller.

14. The sheet processing method according to claim 11, wherein a direction of sheet conveyance to the fold-enhancing component is defined, and the auxiliary roller is arranged upstream in the direction of sheet conveyance from the fold-enhancing roller.

15. The sheet processing method according to claim 11, further comprising:

rotating the auxiliary roller in a unified manner with the fold-enhancing roller.

16. The sheet processing method according to claim 11, wherein the auxiliary roller is provided coaxially with the fold-enhancing roller.

17. The sheet processing method according to claim 11, further comprising:

forming a groove extending in a direction intersecting a circumferential direction on an outer circumferential surface of the auxiliary roller.

18. The sheet processing method according to claim 11, wherein the auxiliary roller is softer than the fold-enhancing roller.

19. The sheet processing method according to claim 12, wherein a direction of sheet conveyance to the fold-enhancing component is defined, and an axial line of rotation of the fold-enhancing roller and the opposite member extends in a sheet direction of conveyance.

20. The sheet processing method of claim 11, wherein a resin film is provided between the sheet and the auxiliary roller.

* * * * *